US005345238A

United States Patent [19]

Eldridge et al.

[11] Patent Number: 5,345,238

[45] Date of Patent: Sep. 6, 1994

[54] SATELLITE SIGNATURE SUPPRESSION SHIELD

[75] Inventors: Morton T. Eldridge, Madison; Karl H. McKechnie; Richard M. Hefley, both of Huntsville, all of Ala.

[73] Assignee: Teledyne Industries, Inc., Los Angeles, Calif.

[21] Appl. No.: 494,278

[22] Filed: Mar. 14, 1990

Related U.S. Application Data

[63] Continuation-in-part of Ser. No. 492,847, Mar. 13, 1990, abandoned.

[51] Int. Cl.[5] ..... H01Q 15/16; H01Q 17/00

[52] U.S. Cl. ..... 342/3; 342/10; 342/2

[58] Field of Search ..... 342/2, 4, 8, 10, 9, 342/3, 13

[56] References Cited

U.S. PATENT DOCUMENTS

| | | | |
|---|---|---|---|
| 3,064,534 | 11/1962 | Tumavicus | 342/10 X |
| 3,115,630 | 12/1963 | Lanford | 342/10 |
| 3,122,743 | 2/1964 | Vlasic | 342/10 |
| 3,206,749 | 9/1965 | Chatelain | 342/10 |
| 3,220,004 | 11/1965 | Gillespie, Jr. | 342/10 |
| 3,327,308 | 6/1967 | Henjum | 342/10 |
| 3,568,191 | 3/1971 | Hiester et al. | 342/8 |
| 3,699,576 | 10/1972 | Hoyer | 342/10 |
| 3,773,684 | 11/1973 | Marks | 342/2 X |
| 4,044,358 | 8/1977 | Manning et al. | 342/2 |
| 4,063,241 | 12/1977 | Jouanno | 342/8 |
| 4,170,010 | 10/1979 | Reed | 342/1 |
| 4,314,682 | 2/1982 | Barnett et al. | 342/3 X |
| 4,740,056 | 4/1988 | Bennett | 342/8 |
| 4,825,599 | 5/1989 | Swann, Jr. | 342/10 X |
| 4,901,081 | 2/1990 | Bain, Jr. et al. | 342/8 |

*Primary Examiner*—John B. Sotomayor

*Attorney, Agent, or Firm*—Beveridge, DeGrandi, Weilacher & Young

[57] ABSTRACT

An inflatable shield for suppressing the characteristic radiation signature of a satellite is described. The shield is conical-shaped and made from a thin synthetic polymer film material coated with a radiation reflecting material, such as gold or aluminum. At least one subliming agent is contained within the shield to inflate the shield when exposed to heat. An ultraviolet curable slurry coats the inner walls of the shield and permanently hardens the shield upon exposure to ultraviolet radiation from a self-contained source. The shield optionally may include absorbing and desiccant agents to absorb unwanted gas and water and prevent interference with the primary mission of the satellite. Additional means may be included for moving and positioning the shield with respect to the satellite.

22 Claims, 6 Drawing Sheets

SATELLITE SIGNATURE SUPPRESSION SHIELD

RELATED APPLICATION DATA

This application is a continuation-in-part of U.S. patent application Ser. No. 07/492,847, filed Mar. 13, 1990, now abandoned.

BACKGROUND OF THE INVENTION

This invention relates to a satellite signature suppression shield for camouflaging a satellite's location from ground based and airborne tracking and detection systems. The purpose of the invention is to suppress the laser, radar, visible and infrared signatures of satellites to make it difficult or impossible for hostile enemy forces to damage or destroy satellites in orbit.

Several systems are known which are used to cripple or destroy orbiting satellites or other space vehicles. These systems may be ground based or space based. Typical systems used for destroying satellites include kinetic energy weapons delivered by anti-satellites; directed energy weapons such as high energy lasers, neutral particle beams, high-powered microwave radiation, and other nuclear radiations; and broad-area electromagnetic pulses. Before the satellite can be destroyed, however, it must be detected in space, and the weapon must be aimed such that the destructive force will intercept the path of the satellite. This invention relates to a device which makes it difficult or impossible to locate and track the satellite. When the word "satellite" is used in this specification, other space based mechanisms and vehicles are considered to be within the realm of the invention.

To destroy a satellite, the weapon operator must aim his weapon either to lead the satellite such that the energy beam (or the like) and target arrive at the same location at the same time, or the weapon must be able to track the satellite's location. Should the aim of the gunner be off, in the case of an unguided projectile, the gunner will miss the target. In the case of a guided projectile, the target position, velocity and acceleration information must be accurate enough to enable the projectile to come near enough to its target to be effective. If the input data is inaccurate or too late, the operator will not be able to make the appropriate corrective actions, and the weapon will miss.

Several factors influence the accuracy of the weapon and its ability to locate its target in outer space. Some factors make tracking satellites easier, and some factors make this more difficult. For example, ground based weapons are looking into outer space, i.e. into a non-reflective background. Oftentimes space based weapons systems are also looking out into the non-reflective background of outer space. This makes the tracking of the target easier, because there is no background radiation or other noise background in the sensor's view. The satellite, which is a radiation source and a radiation reflector, is very evident in this radiation-free background. When a tracking sensor is viewing a radiation scene from the air toward the earth's surface, it is more difficult to locate and track a satellite because of all of the background radiation from the earth and/or the objects below. Thus, it is easier for ground based weapon sensors, or sensors using outer space as a background, to track satellites.

Another factor which makes it easier to track satellites is the fact that once a satellite or other space object is in orbit, they follow very precise orbital tracks.

Therefore, once a satellite's position is accurately determined and tracked, predictions of the future location of this satellite are very accurate. Some external forces, such as solar winds, do act on these satellites to alter their orbits; however, such orbital changes are typically small and gradual. Satellites are typically very limited in their maneuverability after they are in orbit. If they can be maneuvered at all, usually a very limited propulsion power supply is available, and there is no way to recharge the power supply. Hence, maneuvering is done infrequently and to a very limited extent. This makes satellites relatively easy to track. Airplanes, on the other hand, are continuously maneuverable because they have a readily available power supply. Thus, airplanes can continuously change directions to avoid ease in tracking and engagement with weapons.

There are other factors which make it more difficult to track and destroy satellites. One factor is the large distance between the ground based or space based attacker and the satellite. The attacker and target may be separated by hundreds of miles if the satellite is at relatively low altitudes, and even thousands of miles for higher altitudes. Therefore, the sensors being used must be highly directional and very powerful. Ground based sensors, in order to cover any significant area of space, must have many individual sensors which make up a large sensor device. These sensors cannot be proliferated in any way comparable to air defense sensors, and they are not easily moved. Therefore, the satellite launching party will know the location of the detecting sensors, and he will know when and where his satellite is detectable by the ground based sensor systems.

The large distance creates another problem when energy beams are employed as the weapon used for destruction. Because of this distance, in order for the energy beam to be effective when it reaches the target, extremely narrow beams must be used. The beam must reach the target with enough energy density to damage the target. This greatly complicates the aiming task, since the aiming must be very precise. Radar is not precise enough to aim the directed energy beams at great distances; very accurate closed loop laser or optical tracking systems must be used for aiming.

Another difficulty in tracking satellites results from the relative speeds of space objects. Not only are the targets difficult to locate, but they must be tracked for some significant time before the intercept is made. Low altitude objects are only in the sensor's field of view for a short time period; high altitude satellites require a long time period for the projectile to reach its target. The weapons used must have sufficient propulsion and acceleration energy to reach the location of the satellite. Any significant delay in dispatching the weapon may allow the satellite to exit the sensor's field of view before it can be tracked, or it may increase the separation distance such that the satellite is no longer within the weapon's range.

If the satellite signature or the energy required by the weapon tracking system is reduced or suppressed significantly, there may not be enough energy remaining for the weapon's tracking system to locate and track the target within the time period in which a successful attack may be launched. Reducing the available engagement time also enhances other satellite protection mechanisms, such as maneuverability, decoy deployment or other electronic counter measures.

The satellite signature is the characteristic pattern of radiation which is emitted by or reflected from the satellite. This signature enables remote based sensors to identify the object as a satellite. Various methods of reducing the signature radiation are known. For example, small dipole scatterers and absorbers have been used in camouflage shields to alter the radar signature of the satellite to make it appear like background. Other camouflage materials include special pigments which absorb radiation and re-radiate it at the proper wavelength so as to appear like chlorophyll to infrared sensors. Absorbing and non-reflecting materials have been used since World War II to reduce radar and sonar signatures on tactical aircraft and submarines, respectively. Curved surfaces and slanted configurations are also used to reduce well-defined edges at which radar (and sonar) reflection occurs. These configurations are currently used in the stealth bombers, and various other fighter and bomber aircraft.

SUMMARY OF THE INVENTION

In order for camouflage to be effective, the target must blend in with the background by incorporating similar visible, laser, radar, and infrared signatures. On earth, such backgrounds typically include woodlands, deserts, or arctic tundra. As indicated above, the typical background of a satellite is the void of outer space. Using absorbing or non-conducting materials as camouflage for a satellite would be useful for protection against radar to some extend; however, it would not offer much protection from active laser tracking systems. Nor would it be useful as visible and infrared radiation signature suppression.

It is an object of this invention to provide a satellite signature suppression shield which is effective against active and passive detection systems. Examples of active tracking systems include radar and laser tracking systems; examples of passive detection systems include infrared and visible radiation detection systems.

It is another object of this invention to provide a satellite signature suppression shield which utilizes reflective surfaces to reflect radiation away from the satellite and away from the tracking sensors.

It is a further objective of this invention to provide a satellite signature suppression shield which is movable with respect to the satellite, such that the shield may be oriented in the direction of the threat.

It is another object of this invention to provide an inflatable satellite signature suppression shield which is inflated and rigidized at a remote location.

These and other advantageous aspects of this invention may be realized by providing an airtight conical-shaped inflatable shield wherein at least one subliming material is included. The shield further includes rigidizing agents, and optionally absorbing agents and desiccant materials.

BRIEF DESCRIPTION OF THE DRAWINGS

These and other advantageous aspects of this invention will become apparent from the following detailed description taken in conjunction with the attached figures, wherein.

Figure 4:
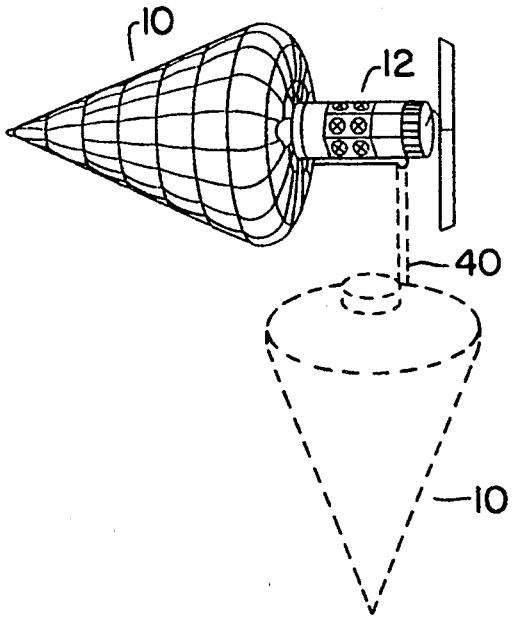
Figure 5:
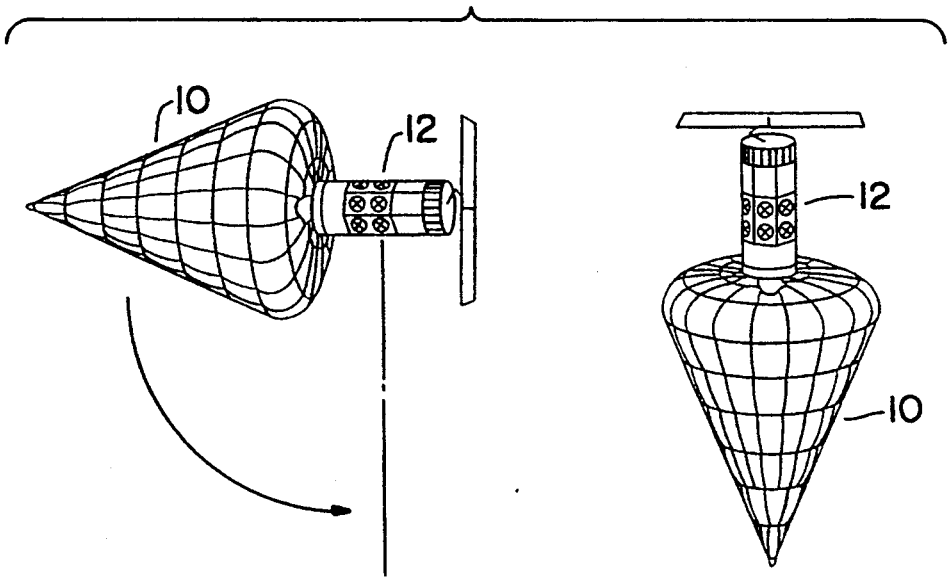

FIGS. *2a–2d* show the shield in various stages of inflation;

FIGS. *3a–3d* are graphs showing the effectiveness of the shield for various types of radiation;

FIGS. 4 and 5 show alternative embodiments of the invention; and

Figure 6:
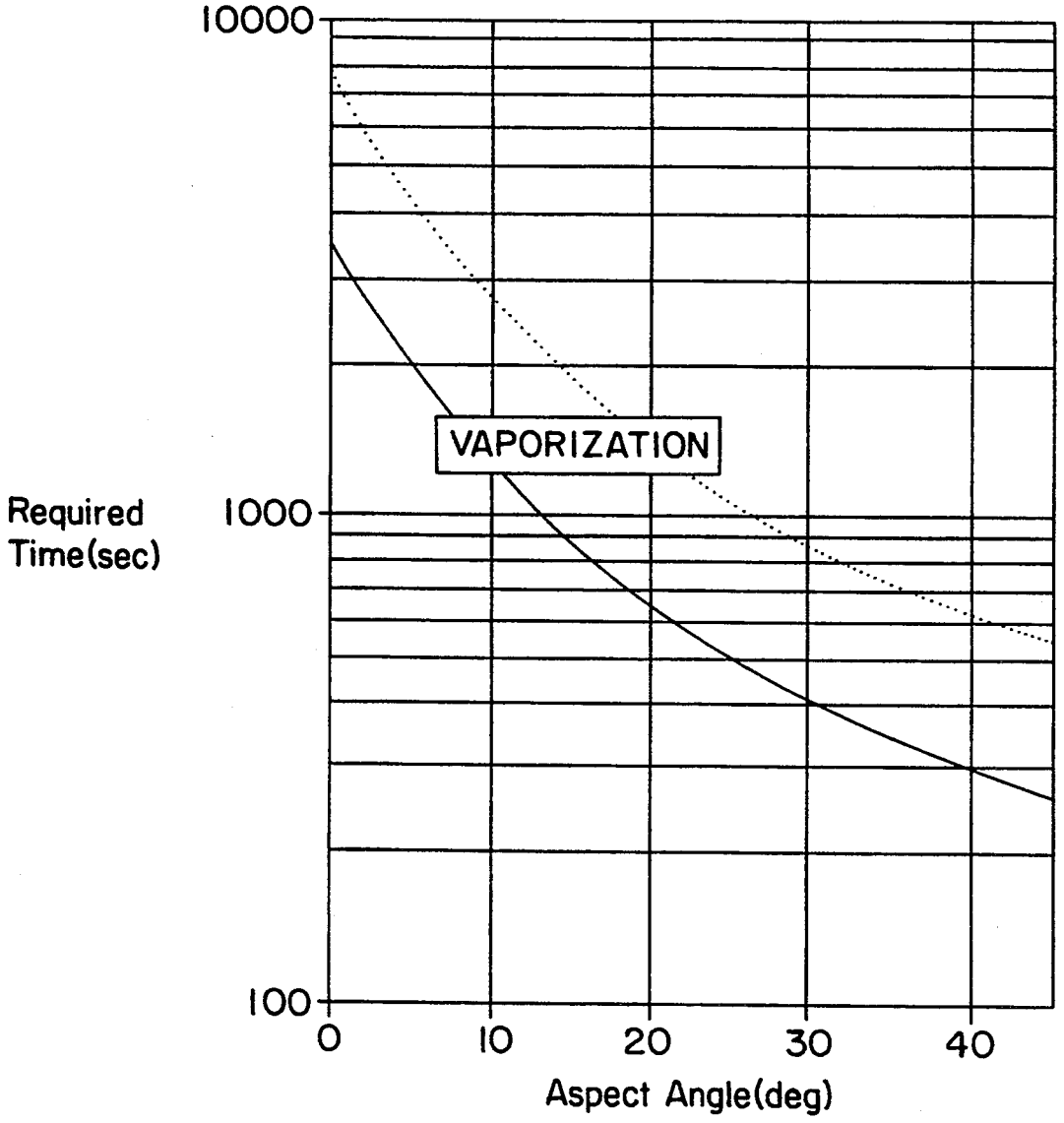

FIG. 6 is a graph showing the time required for vaporization of the reflective film by a high energy laser source.

DETAILED DESCRIPTION OF THE INVENTION

Active detection systems operate by bouncing a radiation beam off of the body to be tracked, and then detecting the reflected radiation via radiation sensors. This is the basic theory of operation behind laser, radar and sonar detection systems (sonar using sound waves). If the radiation beam is not returned to the sensors, then there is no detection of the target.

Figure 1:
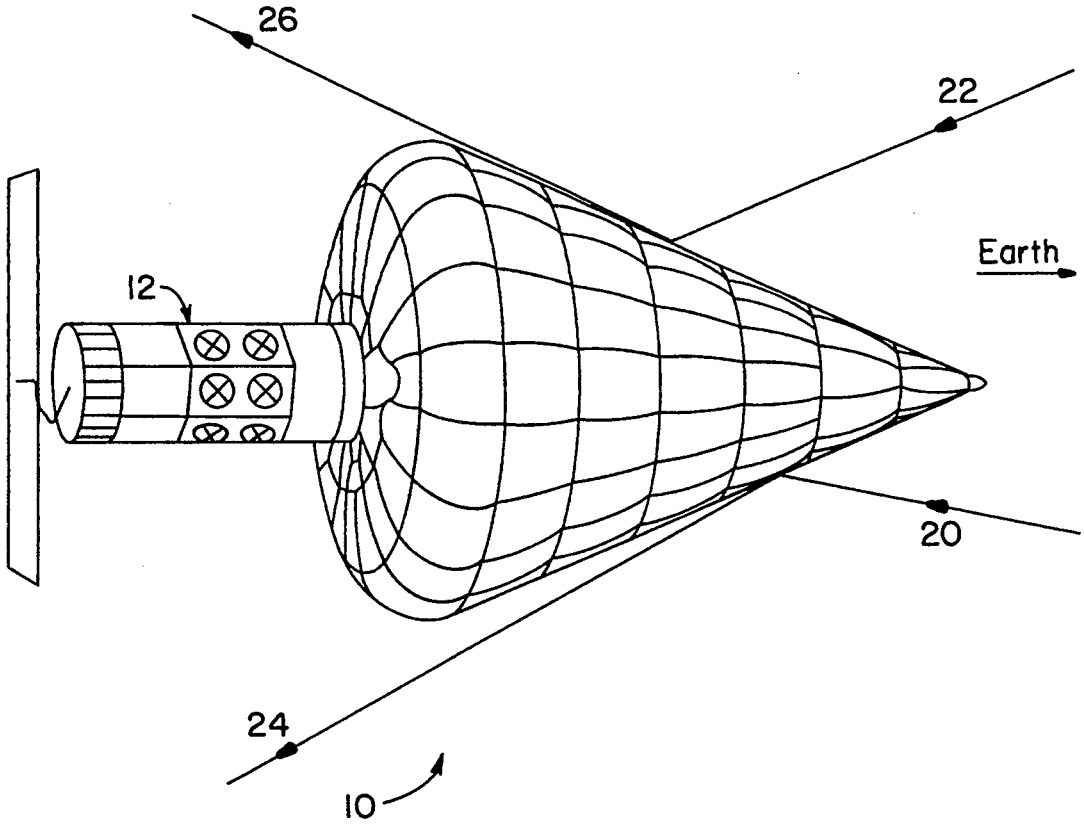
FIG. 1 shows the satellite signature suppression shield in accordance with the invention, fully deployed and in operation.

The shield of this invention, in the preferred embodiment, is conical-shaped, as shown in FIG. 1. Incoming radiation (radar or laser) from a ground based active tracking system impinges upon the shield 10 as shown by beams 20 and 22. The radiation beams 20 and 22 interact with the reflective coating on the shield material and are bounced harmlessly into space, as shown by reflected beams 24 and 26. The shield thus provides protection for the satellite, shown at 12, since the radiation is not backscattered to the sensors which are located on the earth.

The shield 10 is preferably made in the form of an inflatable balloon. The inflation process is shown in Figs. *2a–2d*. The satellite 12 is initially deployed and set in its appropriate orbit with the balloon shield enclosed behind movable panels 30, preferably hermetically sealed panels forming a canister 28, as shown in FIG. *2a*. The nose of the cone 32 may extrude from behind the panels 30. After the satellite 12 is in position in space, the panels 30 are retracted as shown in FIG. *2b*, thus exposing the uninflated balloon material 34. Any suitable mechanical retracting means may be used, such as an electrical solenoid. The movable doors 30 may be spring loaded, such that the doors are initially moved by a solenoid, and then the spring mechanism releases the doors. The entire balloon may be mounted on a spring to push it out of its holder and into the environment. The doors 30 are controlled from the earth, in the preferred embodiment; however, the movement of the doors 30 may also be controlled by an on-board timer or automatically activated in response to an on-board sensor. The satellite may be deployed in space for a long time before inflation of the shield is necessary, because of threat of attack etc. Automatic activation by a computer program is also possible. The method of triggering activation may depend upon the type of satellite being protected, or the type of attack being protected against.

In the preferred embodiment of this invention, the balloon material is a very light weight synthetic polymer film, such as Kapton (polyimides manufactured by DuPont) or Mylar (polyethylene terephthalates manufactured by DuPont), conical-shaped into a skin material, typically approximately 1 mm thick. The conical material further includes inflatable reinforcing ribs which provide initial rigidity and shape to the shield. The Kapton or Mylar skin material is coated with an extremely thin layer of radiation reflecting material. A 0.05 micron gold coating is used in the preferred embodiment. The coating and balloon skin thicknesses may be adjusted to suit the particular satellite or the type of weapon being protected against. The particular thicknesses mentioned are merely exemplary. Adjustment of the thicknesses are deemed within the skill of the art.

The cone angle may be varied greatly, depending upon various factors, such as orbital altitude, shield weight etc. For low altitude orbits, a cone full angle of 40° may be used (half angle is 20°), assuming that the cone tip is pointing at the earth's nadir. Angles as large as 160° may be used for geosynchronous satellites. The larger the cone angle, the lower the required cone area, and consequently, the cone's weight is lowered. However, if the cone angle is made too large at low orbital altitudes, the cone face may present an orthogonal face off from which active tracking radiation may be reflected back to the earth based sensors. This orthogonal face must be avoided to effectively conceal the satellite.

At low altitudes, weapon sensors can view a satellite from an angle as low as 30° above the horizon. This means that an orthogonal face would produce a spike on the sensors if the cone half angle were 30°, or a 60° full angle. Since the satellite may rotate or oscillate in its orbit, a 40° full angle on the cone provides an extra conservative protection system. The higher the orbit altitude, the higher the cone angle may be to provide adequate protection from earth based sensors.

Figure 2A:
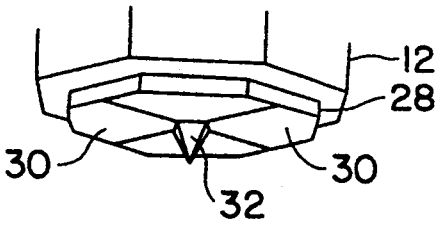
Figure 2B:
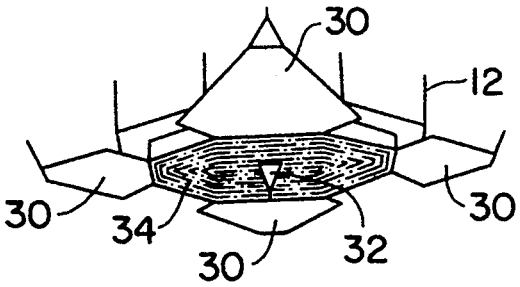
Figure 2C:
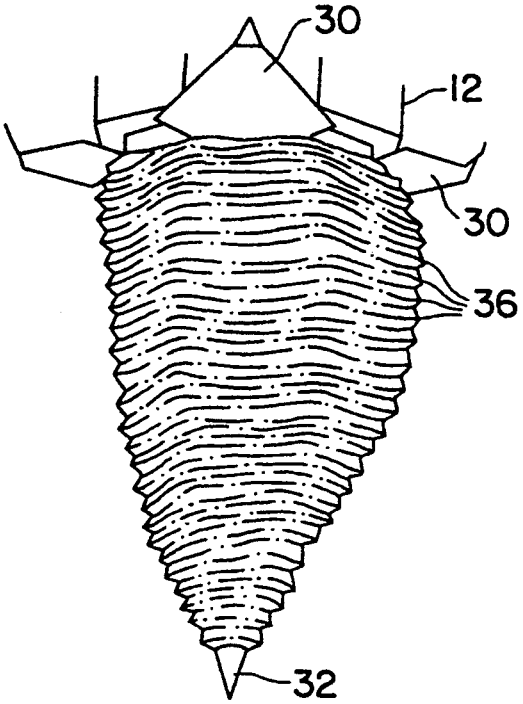

FIG. 2*c* shows the cone shield during the intermediate inflation stage. As mentioned above, the cone includes inflatable reinforcement ribs 36 which help provide an initial rigid shape. The cone is inflated in the preferred embodiment through the use of two subliming agents, although a single subliming agent may be used. The retractable covers 30 form the canister 28 which is preferably hermetically sealed to protect against unwanted sublimation of these materials before the cone is released from the canister 28 for deployment. When subjected to heat, such as heat from the sun in the preferred embodiment, these agents transform from a powdered solid material directly into a gaseous phase. This sublimation process may take from a few seconds to a few minutes. The first subliming agent, in the preferred embodiment, sublimes at a relatively fast rate, to provide the initial inflation and shape for the shield. It is preferred to uniformly coat the balloon with the subliming powdered material, since this provides uniform inflation. It is possible to burst the balloon if the inflation takes place too rapidly. A balance must be established between the amount of subliming powders, balloon volume, and time until rigidized, so as to properly inflate and remove all of the wrinkles without bursting the balloon skin.

During use, the satellite shield is subjected to micrometeoroid collisions which produce micropunctures in the balloon skin wall. Furthermore, some gas may diffuse through the balloon skin wall. This escaping gas may cause the shield to deflate before it could be permanently rigidized. To obviate this problem, the shield includes a second subliming agent. The second subliming agent sublimes at a slower rate than the first subliming agent, thus providing an additional gas source to make up for any gas which escapes, as described above. The pressure in the shield is thus maintained until permanent rigidization can occur. Subliming agents are chosen such that transfer to the vapor state at the temperature and pressure conditions of outer space is accomplished. One example of an appropriate subliming material is chloroacetic acid, which sublimes at 61°–63° C. Other suitable subliming agents are those used in the ECHO satellite. The subliming agents are also chosen such that the appropriate rate of sublimation is accomplished. The choice of sublimatory materials is a combination of these factors and within the skill of the art.

Heat from the satellite may also be used as the sublimation heat source, or an independent heat source may be provided in the cone.

The inside of the balloon skin is coated with a rigidizing material. In the preferred embodiment, this material is an ultraviolet curable material which coats the inside of the balloon skin. The ultraviolet curable material may be Light Weld Products 416,488 and 489, which are UV curing adhesives adapted for use with clear plastics, manufactured by Dymax Corporation of Torrington, Conn. Other suitable ultraviolet curable materials may be used without departing from the invention. The rigidizing material typically has the consistency of a slurry, like a soft glue or paste. When exposed to ultraviolet radiation, this material hardens to become permanently rigid. By "hardened" in this specification, a firm structure to provide a mirror-like surface is being referred to. The balloon has a consistency similar to that of a garbage bag. The hardening agent is necessary to provide the mirror-like surface and to avoid the presence of wrinkles or creases. Wrinkles and creases increase the signature levels and thus make the shielding less effective. It is still expected that micrometeoroids will penetrate the fully hardened balloon material, although the hardened shell may stop penetration of some meteors. One purpose of the hardening agent is to obviate the need for a pressurized gas supply, therefore, lessening the weight of the satellite and shield.

Figure 2D:
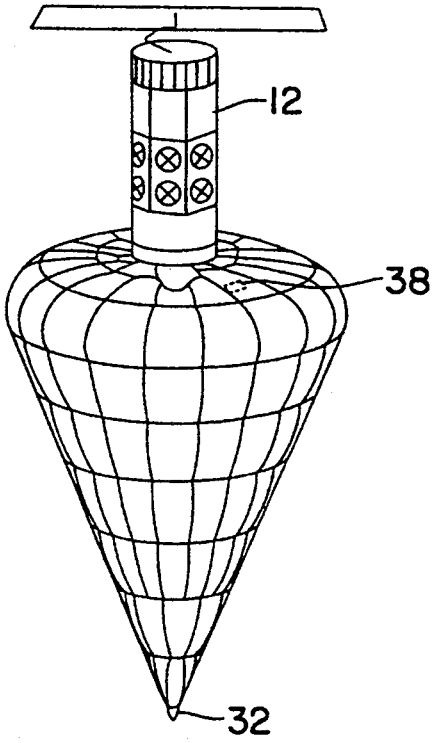

The completely hardened shield structure is shown in FIG. 2*d*. When a UV curable rigidizing material is used, a small ultraviolet radiation source 38 is also contained within the balloon at the base of the cone (shown as phantom lines in FIG. 2*d*) which is used to activate the rigidizing material. The source 38 may be a flash lamp, to get the curing process underway. Full rigidization within a few seconds to a few minutes after inflation is preferred; therefore, a material capable of rapid curing upon exposure to UV radiation is needed. .

The ultraviolet light source used in conjunction with the invention may advantageously be a Light-Welder ultraviolet lamp manufactured by the Dymax Corporation of Torrington, Conn. The ultraviolet lamp and the curable material are matched in wavelength such that the lamp emits the particular wavelength of ultraviolet light needed to cure the rigidizing material. Dymax Corporation manufactures the Light-Welder ultraviolet lamps to match in wavelength to the Light-Weld curable adhesive products described above.

The inside of the conical base of the balloon may further include an activated charcoal getter. The function of the satellite may be interfered with if the organic gases from the inflating and rigidizing elements are allowed to escape from the balloon and migrate around the satellite. These gases can escape through punctures caused by micrometeoroid collisions, as described above. The activated charcoal getter absorbs these gaseous constituents and prevents their leakage and interference with the on-board sensors of the satellite.

The balloon may also preferably include a desiccant material to absorb any water. The desiccant material in the preferred embodiment is silica gel, although any other suitable desiccant may be used. This desiccant also prevents interference with the on-board sensors. The desiccant and/or the activated charcoal is preferably located in a box at the cone base (not shown). After inflation and hardness are completed, this box may be opened (remotely or automatically) and the charcoal and/or desiccant exposed to the balloon interior. This box prevents competition between the inflation and absorbing processes. The absorbing process is relatively slow compared to the inflation and hardening processes.

The cone is shaped so as to avoid the use of any sharp and well-defined corners. The cone base is rounded off, as shown in FIGS. 1 and 2*d*, to prevent reflections of radar currents or standing waves which result in signature spikes. The rounded off base also preferably includes absorptive material which absorbs and reduces the amplitude potential for any standing waves.

Laser and microwave radar energy is reflected into outer space by the shield, as if the cone were a mirror, as described above. Laser radiation is reflected away somewhat better than radar, because some re-radiation of radar is caused by currents created in the metal reflective coating on the skin. The main lobe of this re-radiated radiation is primarily oriented the same as the laser. This re-radiated energy is collected somewhat like an antenna and released at the tip of cone back toward earth. This creates a small signature spike or lobe from the conical tip; however, this lobe can be suppressed by rounding the tip, such that the lobe would only appear when the cone tip and the sensor were perfectly lined up.

Figure 3A:
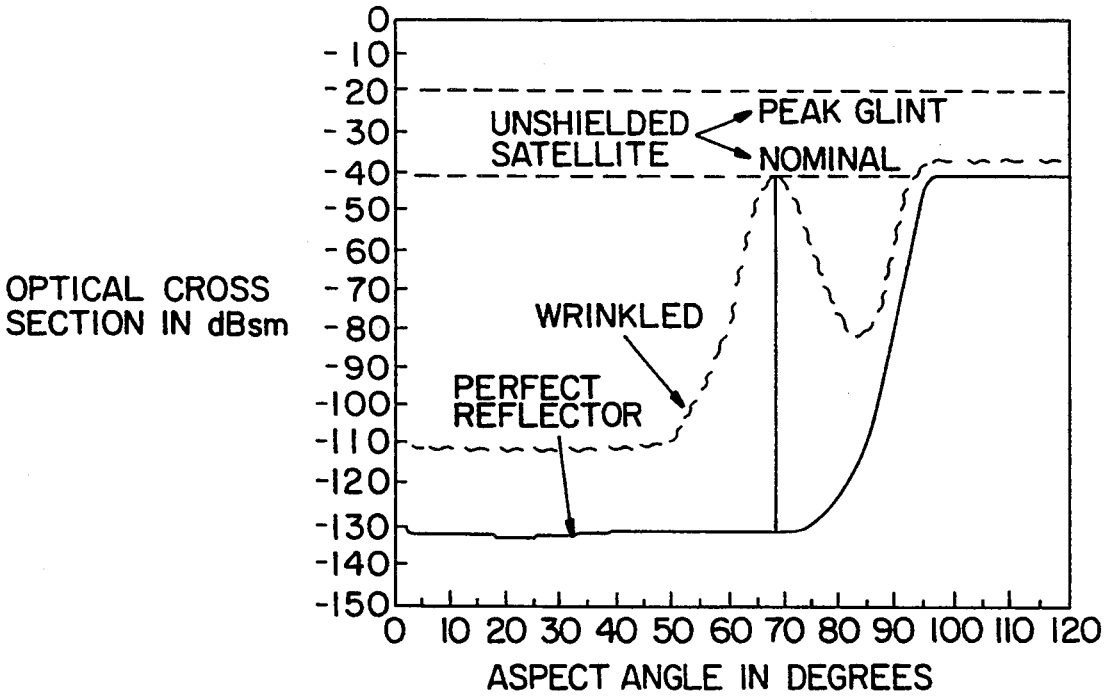
Figure 3B:
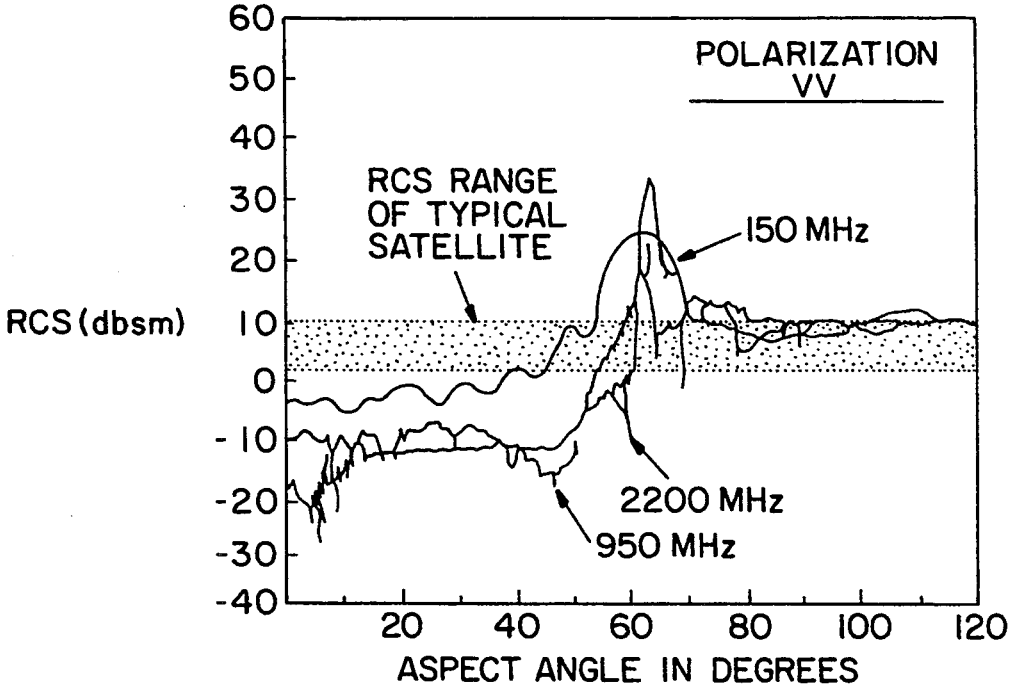

FIGS. 3*a* and 3*b* show the reduction in optical cross section (in dB relative to a square meter, or dBsm)) as a function of the aspect angle. As shown in these figures, the laser signature is reduced by about 90 db for the shielded satellite and the radar signature is reduced by about 15–30 db.

Figure 3C:
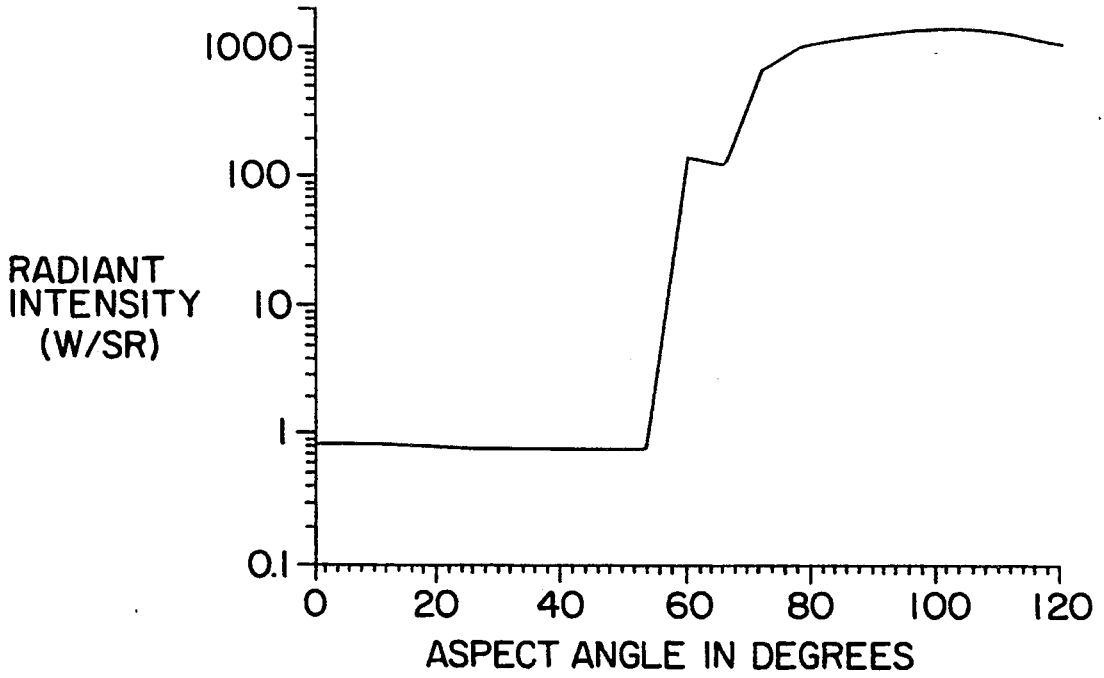

Visible radiation detection is also suppressed by this shield. Visible radiation sensing is primarily the result of radiation reflected from the earth. This light is also reflected into outer space by the shield, with little or no light returning to a ground based sensor. Suppression of visible radiation as a function of aspect angle is shown in FIG. 3*c*. The light which is reflected back to the earth is reduced by approximately three orders of magnitude.

Figure 3D:
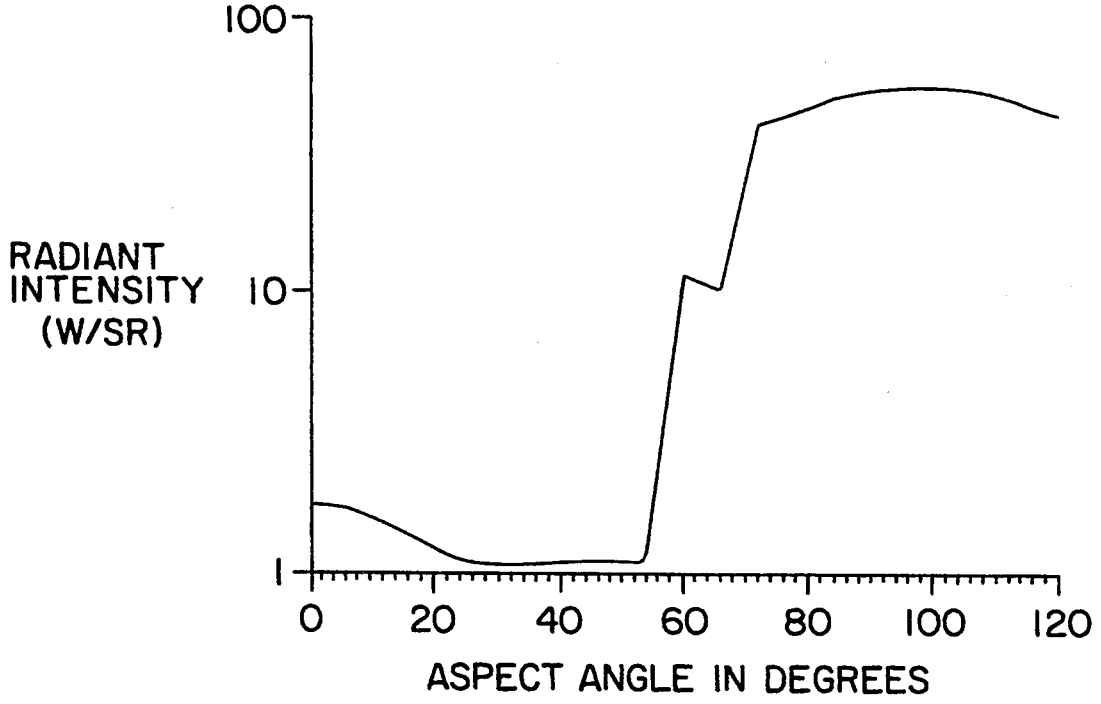

The reflective shield will absorb very little energy from the sun, because of its reflective surface; consequently, the infrared signature from the shield itself is reduced. Fig. 3*d* shows a reduction in the infrared signature to be approximately two orders of magnitude. While the satellite itself will absorb infrared energy from the sun, the location of the shield between the satellite and the sensor shields the sensor from infrared radiation emitted by the satellite.

Another embodiment of the invention is shown in Fig. 4. This preferred embodiment allows the shield 10 to be mounted on a movable arm 40, such that the shield 10 may be moved relative to the satellite 12. In this manner, the cone can be positioned either in the direction of the velocity vector of the satellite, to protect against space-based head-on attacks; or the cone may be positioned in the direction of the reciprocal of the velocity vector, to protect against ground based attack. The conical shield must be pointed in the general direction of the threat, in order to be effective. Any suitable remote (ground based) or automatically controlled motorized device may be used to move the shield arm 40, such as a small electric motor. The arm 40 may be moved based on commands from a remote earth based location, or the arm may automatically respond to a sensor on board the satellite which indicates an incoming threat. The shield is moved only when it is absolutely necessary, and for short time periods, when the threat of attack is imminent. Other intermediate angular orientations are considered to be within the scope of the invention. During times when the satellite is not threatened, the shield may be rotated to such a position that it does not interfere with the primary mission of the satellite. When threatened, the cone location may then be adjusted to point toward the threat, and suppress the satellite signature. The threat may typically last from 10–15 minutes, and then the cone is preferably rotated back. While in use, the cone may interfere with the primary satellite mission. This movable arm design allows the satellite to maintain a stable orbit, and it is a candidate for DMSP-like satellites.

Another alternative embodiment, shown in FIG. 5, rotates the cone location by a propulsion means which rotates the entire satellite. This propulsion means is a low energy consuming device which uses the satellite's power supply. Such propulsion means are known. This design allows for a smaller and simpler shield design. This shield may advantageously be used for Talsat or orbital spares. Orbital spares refer to satellites which are placed into a parking orbit, but left unactivated. When satellites are built, they are typically placed into orbit when they are available, instead of waiting until they are needed. If an activated satellite becomes disabled for any reason, such as enemy attack, an orbital spare may be immediately activated to take its place.

This invention improves over prior art camouflage methods by maximizing the re-radiation away from the return path, and the sensors. Laser signatures are typically reduced $10^6$ times, radar and infrared signatures are reduced 10–100 times, and visible radiation signatures are reduced 1000 times.

The inflatable skin is lightweight and allows for larger protective structures to be built. There are no beams or frames to add weight. This reduces the payload and makes this shield more attractive for use in space, where minimal weight in transport is essential. No pressurized gas bottles or piping are required, since the subliming agent is used. The rigidizing elements eliminate the need for an extra gas supply to maintain a continuous pressure in the inflated balloon. Therefore, the lifetime of the shield is increased without increasing the weight by providing a make-up gas supply.

While the shield skin is thin and lightweight, it is still durable and protecting. By acting as a mirror and reflecting radiation as opposed to absorbing energy, there is some protection against high energy laser attack, even at low altitude. Absorbing materials are more susceptible to damage due to absorption of the laser energy. When using a gold reflective coating, 98–99% of the incoming laser energy is reflected. Assuming a low altitude satellite with a 40° cone (full angle), the angle of the cone increases the area which receives the laser radiation 2.92 times, as compared to a direct orthogonal hit. The increased area of incidence reduces the flux concentration of the laser energy. Since the cone base is larger than the satellite, all the reflected radiation is bounced past the satellite into outer space. The satellite cone will have to be destroyed before the high energy laser can destroy the satellite itself.

If a high energy laser (HEL) is being used to attack the shield, the laser must irradiate the cone with an energy above 10 watts per square centimeter normal for more than two minutes continuously to damage the gold coating. Occasional short term hits will do no damage except by lasers with a much higher energy than currently considered practical. Higher laser energy levels will do damage in less time, but the signature suppression levels are low enough, that closed loop tracking of the satellite is impractical at altitudes above 100 km. FIG. 6 shows the time required for vaporization of the metal film over the balloon skin as a function of the aspect angle. Direct irradiation with a 10 $W/cm^2$ laser beam was used. The dotted line in the figure represents a 10 micron gold film over a 0.5 mm Kapton skin. The solid line represents a 10 micron aluminum film over a 0.5 mm Mylar skin.

The satellite shield size and thickness depends on various factors, such as orbital altitude and the size of the satellite to be protected. Shields with a base diameter of a few feet to over 40 feet are within the scope of the invention. While quite large satellite shields are possible, the shields are still extremely lightweight and effective.

The shield is quickly deployable, within a time frame of a few seconds to several minutes. The shield may be inflated immediately after the satellite is placed in orbit or the inflation can be delayed until a crisis or hostile situation exists. The shield is permanently rigidized, so a long lifetime can be expected, and the shield can be specially tailored to the particular spacecraft and orbital situation.

While the invention has been described in conjunction with particular embodiments, various modifications may be made without departing from the invention as defined in the appended claims.

We claim:

1. An inflatable satellite signature suppression shield comprising:

(a) an inflatable balloon enclosure wherein an outer surface thereof predominantly reflects radiation, so as to reflect radiation away from any ground or air based sensor;

(b) inflation means located within said enclosure for inflating said enclosure; and (c) hardening means located within said enclosure for rigidizing the walls of said enclosure after inflation.

2. An inflatable shield according to claim 1, further including inflatable ribs for reinforcing the shield during inflation and prior to hardening.

3. An inflatable shield according to claim 1, wherein said inflation means includes at least one subliming agent.

4. An inflatable shield according to claim 3, wherein said subliming agent includes at least two subliming agents which sublime at different rates.

5. An inflatable shield according to claim 1, wherein said hardening means includes an ultraviolet curable slurry material coated on the walls of said enclosure, and an ultraviolet radiation source located within said enclosure, wherein said slurry material hardens upon exposure to ultraviolet radiation.

6. An inflatable shield according to claim 1, wherein said shield further includes an absorbing means comprising an activated charcoal material.

7. An inflatable shield according to claim 6, wherein said absorbing means further includes a desiccant material.

8. An inflatable shield according to claim 1, wherein said shield further includes an absorbing means comprising a desiccant material.

9. An inflatable shield according to claim 1, wherein said shield is movably mounted on a satellite.

10. An inflatable shield according to claim 9, wherein said shield is mounted on an arm which is movably attached to said satellite.

11. An inflatable shield according to claim 1, wherein said enclosure includes a skin made from a gold coated synthetic polymer film material.

12. An inflatable shield according to claim 1, wherein said enclosure includes a skin made from an aluminum coated synthetic polymer film material.

13. An inflatable satellite shield comprising:

(a) an essentially air-tight balloon enclosure which predominantly reflects incident radiation, so as to reflect radiation away from any ground or air based sensor;

(b) at least one subliming agent located within said enclosure for inflating said enclosure;

(c) an ultraviolet curable slurry for coating the inside of said enclosure; and (d) an ultraviolet radiation source to cure said slurry, said source contained at least partially within said enclosure,

14. An inflatable satellite shield according to claim 13, wherein said shield is movably mounted on a satellite.

15. An inflatable satellite shield according to claim 13, wherein said shield is conical shaped.

16. An inflatable satellite shield according to claim 13, wherein said balloon enclosure is stored in a hermetically sealed canister attached to said satellite prior to inflation.

17. An inflatable satellite shield according to claim 13, wherein said shield further includes absorbing material located within said enclosure.

18. An inflatable satellite shield according to claim 17, wherein said absorbing material includes activated charcoal and a desiccant.

19. An inflatable satellite signature suppression shield according to claim 1, wherein said balloon enclosure is stored in a hermetically sealed canister attached to said satellite prior to inflation.

20. An inflatable satellite signature suppression shield according to claim 1, further including absorbing means located within said enclosure.

21. An inflatable satellite signature suppression shield comprising:

(a) an inflatable balloon enclosure having a tapered outer surface, wherein said outer surface thereof predominantly reflects radiation;

(b) inflation means located within said enclosure for inflating said enclosure; and (c) hardening means located within said enclosure for rigidizing the walls of said enclosure after inflation.

22. An inflatable satellite shield comprising:

(a) an essentially air-tight balloon enclosure having a tapered outer surface which predominantly reflects incident radiation;

(b) at least one subliming agent located within said enclosure for inflating said enclosure;

(c) an ultraviolet curable slurry for coating the inside of said enclosure; and (d) an ultraviolet radiation source to cure said slurry, said source contained at least partially within said enclosure.

* * * * *